US005531607A

United States Patent [19]

Yagi et al.

[11] Patent Number: 5,531,607

[45] Date of Patent: Jul. 2, 1996

[54] CONNECTOR

[75] Inventors: Sakai Yagi; Masanori Tsuji; Motohisa Kashiyama, all of Shizuoka, Japan

[73] Assignee: Yazaki Cororation, Tokyo, Japan

[21] Appl. No.: 161,093

[22] Filed: Dec. 3, 1993

Related U.S. Application Data

[63] Continuation of Ser. No. 963,679, Oct. 20, 1992, abandoned.

[30] Foreign Application Priority Data

Oct. 21, 1991 [JP] Japan ..... 3-272443

[51] Int. Cl.[6] ..... H01R 13/64

[52] U.S. Cl. ..... 439/246

[58] Field of Search ..... 439/246–249, 439/252, 744–747

[56] References Cited

U.S. PATENT DOCUMENTS

| | | | |
|---|---|---|---|
| 3,031,638 | 4/1962 | Bertram et al. | 439/745 |
| 3,513,438 | 5/1970 | Henschen et al. | 439/746 |
| 4,664,460 | 5/1987 | Vandame | 439/747 |
| 4,990,094 | 2/1991 | Chandler et al. | 439/108 |

FOREIGN PATENT DOCUMENTS

| | | | |
|---|---|---|---|
| 293155 | 5/1968 | Australia | 439/744 |
| 51-37283 | 3/1976 | Japan . | |
| 51-3272578 | 12/1991 | Japan | 439/246 |
| 1072159 | 2/1984 | U.S.S.R. | 439/247 |
| 567798 | 3/1945 | United Kingdom | 439/744 |

*Primary Examiner*—P. W. Echols

*Attorney, Agent, or Firm*—Sughrue, Mion, Zinn, Macpeak & Seas

[57] ABSTRACT

There is disclosed a connector in which a metal terminal having stabilizers can be smoothly inserted into a terminal receiving chamber of a connector housing. The connector includes the connector housing having the rearwardly-opening terminal receiving chambers, and the metal terminals each having the projected stabilizers. A tapered insertion guide portion is formed at a rear end of a side wall of the terminal receiving chamber.

9 Claims, 5 Drawing Sheets

CONNECTOR

This is a Continuation of application No. 07/963,679 filed Oct. 20, 1992, now abandoned.

BACKGROUND OF THE INVENTION

This invention relates to a connector used mainly for connecting a wire harness of an automobile.

In FIG. 8 (Japanese Laid-Open Utility Model Application No. 51-37283), a metal terminal c of the male type is inserted in a terminal receiving chamber b of a connector housing a, and is retained by a flexible retaining piece d to be prevented from rearward withdrawal. A pair of stabilizers c1 for stabilizing the inserting posture are formed upright at the upper portion of the metal terminal c, and the stabilizers c1 are engaged in engagement grooves e to prevent a forward withdrawal of the metal terminal and also to prevent the tilting of the metal terminal in a direction intersecting the axial direction, thereby stabilizing the insertion posture.

In the above construction, if the metal terminal c is tilted when the metal terminal c is to be inserted into the terminal receiving chamber b from the rear side thereof, the stabilizers c1 are abutted against a rear end f1 of a wall f of the terminal receiving chamber b as shown in FIG. 9, so that the metal terminal can not be inserted into the terminal receiving chamber. In such a case, the posture of the metal terminal is corrected, and then the insertion is effected again, and therefore there has been encountered that additional time and labor are required for mounting the metal terminal onto the connector housing a.

SUMMARY OF THE INVENTION

With the above problem in view, it is an object of this invention to provide a construction in which even if stabilizers are abutted against a rear end of a wall of a terminal receiving chamber when a metal terminal is to be inserted into the terminal receiving chamber, the posture of insertion of the metal terminal is automatically corrected so that the metal terminal can be smoothly inserted into the terminal receiving chamber.

The above object has been achieved by a connector comprising a connector housing having a rearwardly-opening terminal receiving chamber; and a metal terminal having projected stabilizers, a tapered insertion guide portion being formed at least one of a front end of said stabilizer and a rear end of a side wall forming said terminal receiving chamber. Alternatively, a tapered insertion guide chamfer portion which is directed outwardly is formed at a front end of said stabilizer.

When the stabilizer is abutted against the side wall of the terminal receiving chamber during the insertion of the metal terminal into the terminal receiving chamber, the tapered insertion guide portion or the tapered insertion guide chamfer portion causes the metal terminal to angularly move inwardly to correct its insertion posture.

The present invention further provides a connector comprising: a connector housing; at least one terminal inserted into the connector housing along an insertion axis; and means for rotating the terminal about the insertion axis in association with an insertion motion of the terminal into the connector housing to correctly position the terminal relative to the connector housing without stoppage of the insertion motion.

The terminal rotating means may include a projection formed on the terminal and an end wall formed on the connector housing and abuttable against the projection during the insertion motion, at least one of mutually abuttable surfaces of the projection and the end wall being inclined with an acute angle relative to the insertion axis to allow the projection to slide on the end wall to cause rotation of the terminal in association with the insertion motion thereof.

Alternatively, the terminal rotating means includes a projection formed on the terminal and an end wall formed on the connector housing and abuttable against the projection during the insertion motion, the projection being formed with a chamfered portion to allow the projection to slide on the end wall to cause rotation of the terminal in association with the insertion motion thereof.

DESCRIPTION OF THE PREFERRED EMBODIMENTS

Figure 1:
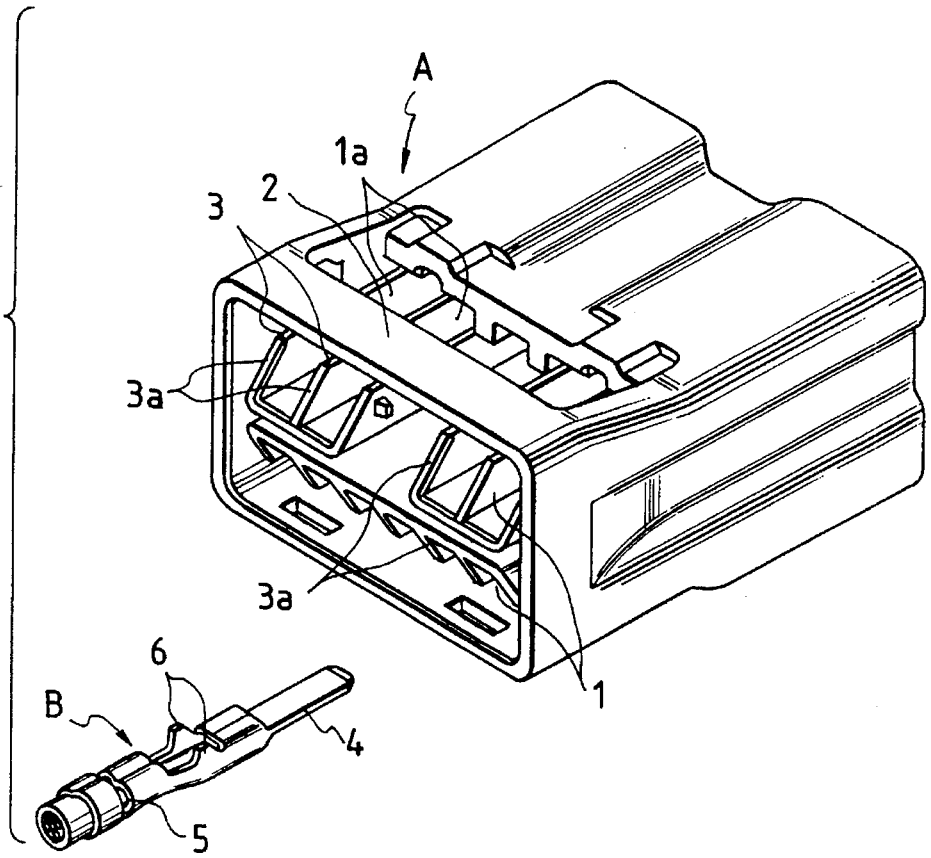
FIG. 1 is a perspective view of one preferred embodiment of the present invention, showing a metal terminal in a separated condition.

Referring to FIG. 1, a connector housing A of a synthetic resin has a plurality of terminal receiving chambers 1 arranged at two (upper and lower) stages, each terminal receiving chamber 1 having front and rear open ends. Each terminal receiving chamber 1 has a flexible retaining piece (not shown) for retaining a metal terminal, and has a notched portion **1*a* in its upper side or its lower side. A hood portion 2 for receiving a terminal holder member (not shown) is provided rearwardly of the plurality of terminal receiving chambers 1. Tapered or slanting insertion guide portions 3*a* are formed respectively at rear ends of opposed right and left side walls 3 forming the terminal receiving chamber 1**.

The metal terminal B includes a male electrical contact portion 4 of a flat configuration, a wire connection portion 5, and a pair of right and left upstanding stabilizers 6, which facilitate rotation of the terminal when inserted in a tilted manner, formed upright intermediate the electrical contact portion 4 and the wire connection portion 5.

Figure 2:
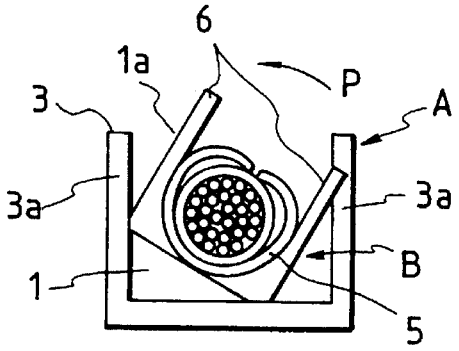
FIG. 2 is an enlarged view of an important portion of the above embodiment, showing the process of insertion of the metal terminal.

In the above construction, if the metal terminal B is tilted as shown in FIG. 2 when the metal terminal B is to be inserted into the terminal receiving chamber 1 from the rear side of the connector housing A, the stabilizer 6 is abutted against the rear end of the side wall 3; however, since the tapered insertion guide portion 3*a* is formed at the rear end of the side wall 3, the metal terminal B is angularly moved inwardly in a direction of arrow P to correct its posture by itself, and then is inserted into the terminal receiving chamber.

Figure 3:
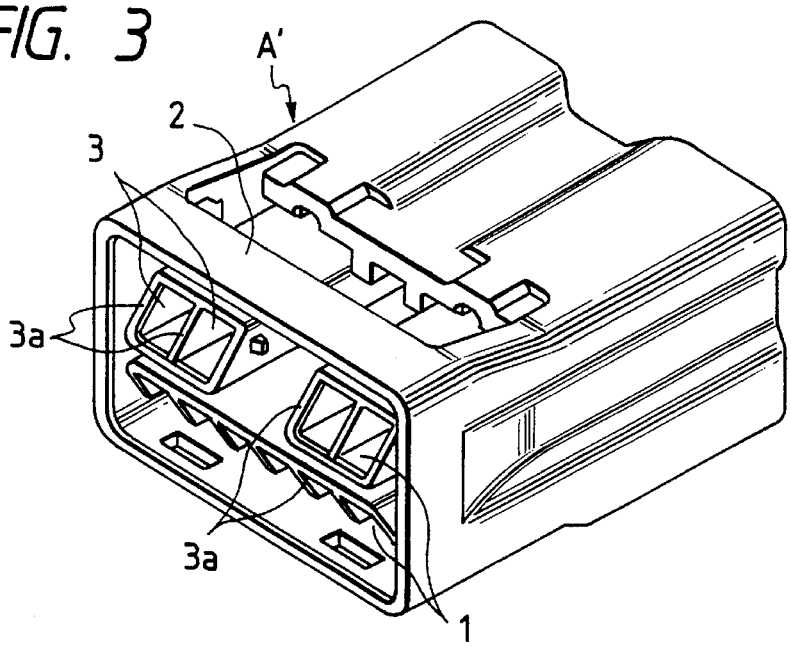
FIG. 3 is a perspective view of a modified connector housing.

In an embodiment shown in FIG. 3, although the above-mentioned notched portion 1*a* is not formed in each terminal receiving chamber 1 of a connector housing A', the tapered insertion guide portions 3*a* are formed respectively at the rear ends of the right and left side walls 3, as described above.

Figure 4:
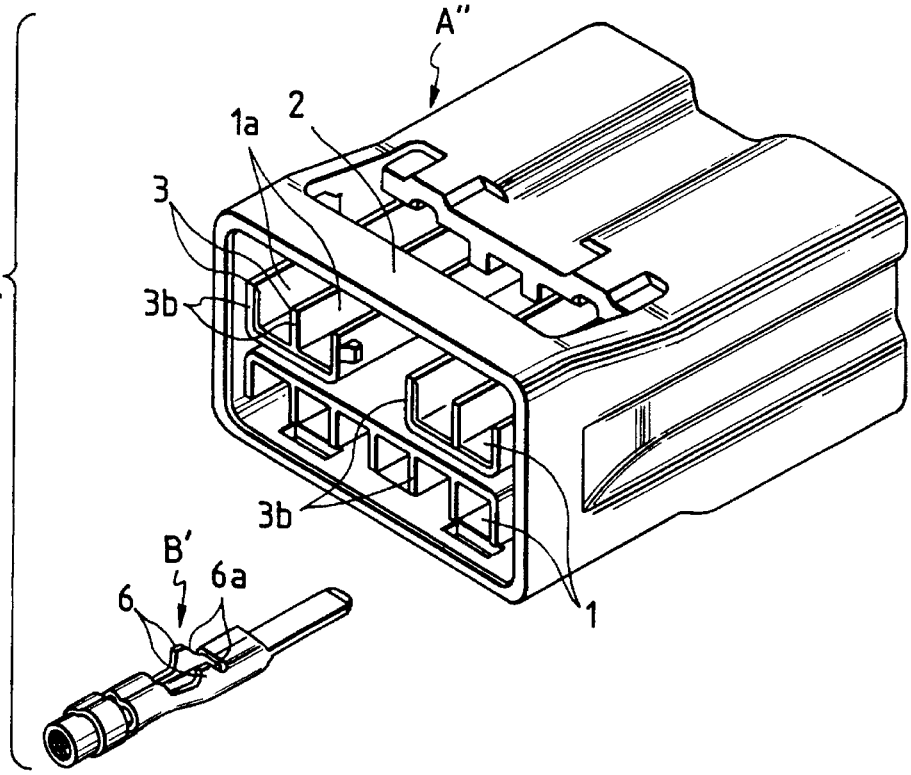
FIG. 4 is a perspective view of a further embodiment of the invention, showing a metal terminal in a separated condition.

In an embodiment shown in FIG. 4, an upwardly-opening or a downwardly opening notched portion 1*a* is formed in each terminal receiving chamber 1 of a connector housing A", and rear ends of right and left side walls are defined respectively by vertical end surfaces 3*b* as in the conventional construction. On the other hand, tapered insertion guide portions 6*a* are formed respectively at front ends of stabilizers 6 of a metal terminal B'.

In the above construction, when the metal terminal B' in a tilted condition is inserted into the terminal receiving chamber 1, the tapered insertion guide portion 6*a* of the stabilizer 6 is abutted against the vertical end surface 3*b* of the side wall 3, so that as the insertion proceeds, the metal terminal B' is angularly moved inwardly to correct its posture by itself, and is completely inserted into the terminal receiving chamber.

Figure 5:
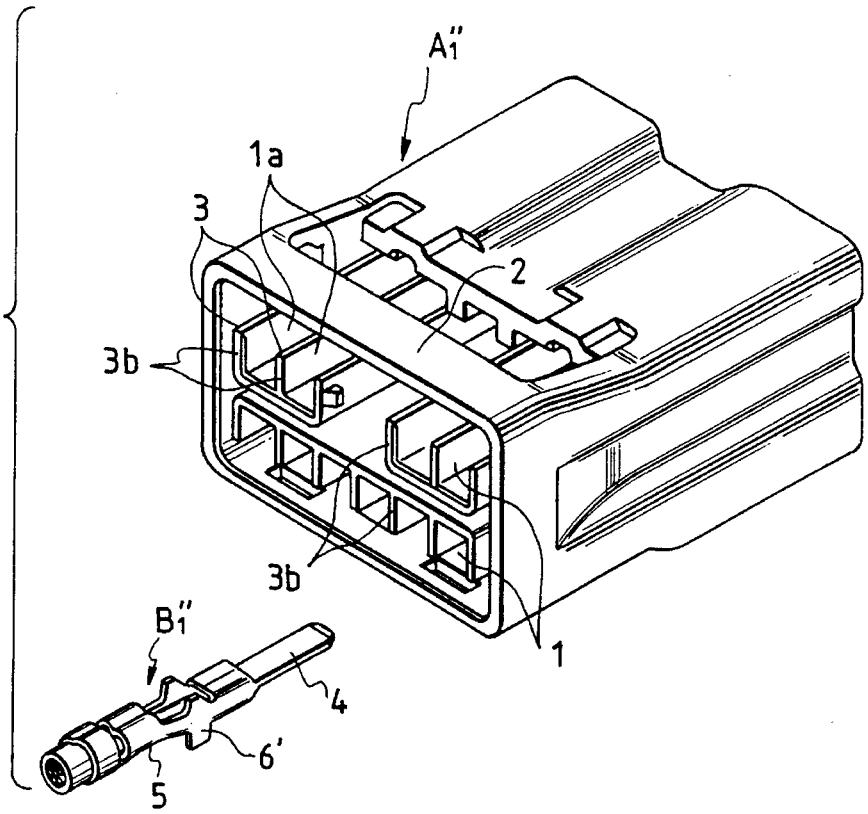
FIG. 5 is a perspective view of a further embodiment of the invention, showing a metal terminal in a separated condition.
Figure 6A:
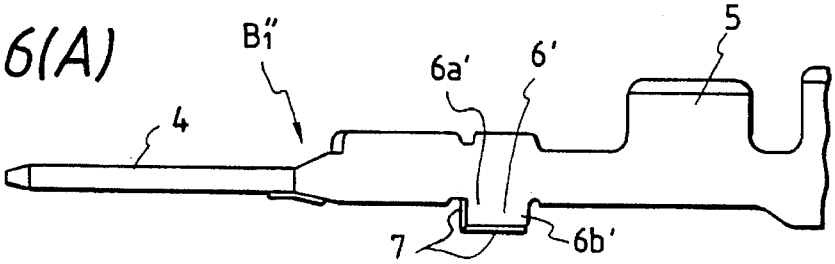
FIG. 6(A) is a side-elevational view of the metal terminal of FIG. 5.
Figure 6B:
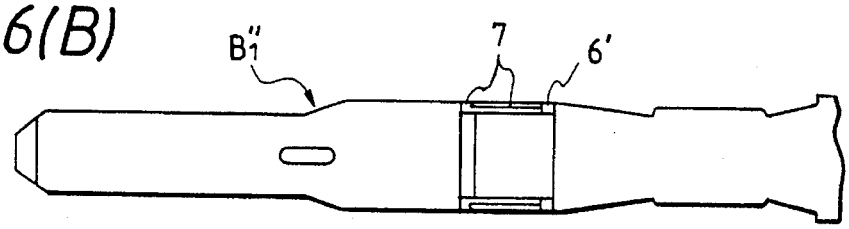
FIG. 6(B) is a bottom view of the metal terminal of FIG. 5.
Figure 6C:
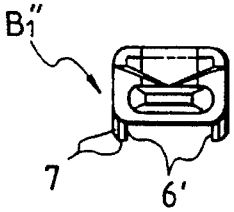
FIG. 6(C) is a front-elevational view of the metal terminal of FIG. 5.

In an embodiment shown in FIG. 5, although a connector housing $A_1$" has a rear end of the same construction as that of the connector housing A" of FIG. 4, a metal terminal $B_1$" has a pair of (right and left) downwardly-projected stabilizers 6' provided intermediate a male electrical contact portion 4 of a flat configuration and a wire connection portion 5, and a tapered insertion guide chamfer portion 7 which is directed outwardly is formed on each of a vertical front end 6*a*' and a lower end 6*b*' of the stabilizer 6' (FIG. 6).

In the above construction, when the metal terminal $B_1$" in a tilted condition is inserted into the terminal receiving chamber 1, the tapered insertion guide chamfer portion 7 is abutted against the vertical end surface 3*b* of the side wall 3, so that as the insertion proceeds, the metal terminal $B_1$" is angularly moved inwardly through the tapered insertion guide chamfer portion 7 to correct its posture by itself, and is completely inserted into the terminal receiving chamber.

Figure 7A:
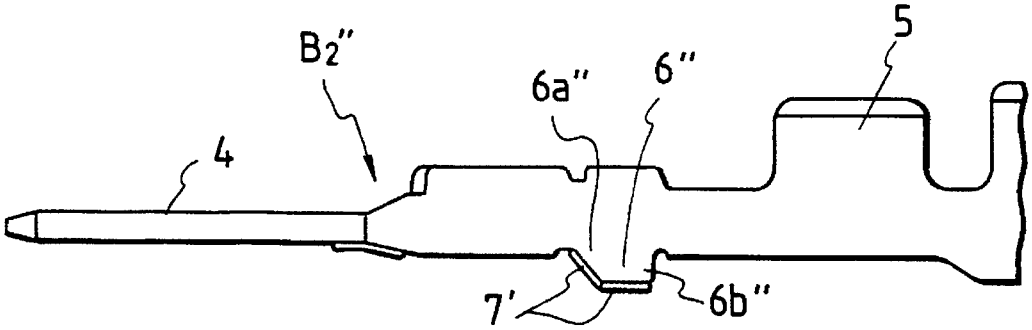
FIG. 7(A) is a side-elevational view of a modified metal terminal.
Figure 7B:
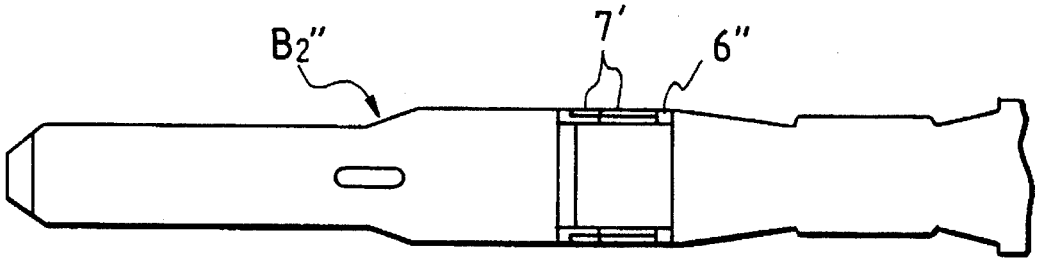
FIG. 7(B) is a bottom view of the metal terminal of FIG. 7(A)
Figure 7C:
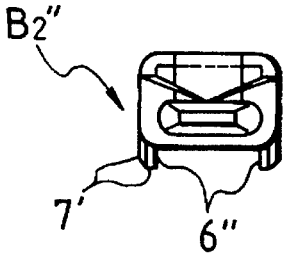
FIG. 7(C) is a front-elevational view of the metal terminal of FIG. 7(A)
Figure 8:
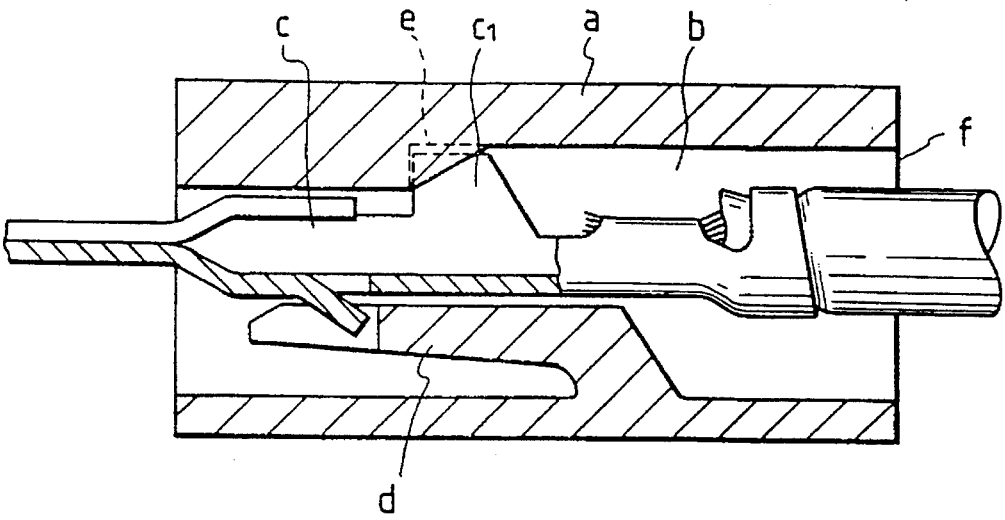
FIG. 8 PRIOR ART
FIG. 8 is a cross-sectional view of a conventional connector.
Figure 9:
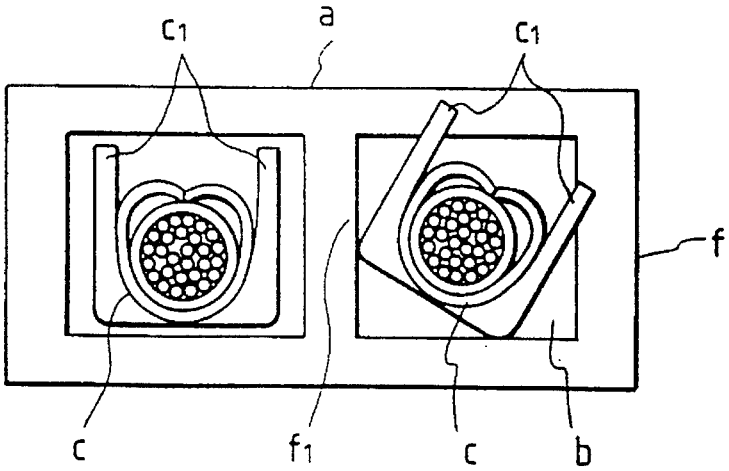
FIG. 9 PRIOR ART
FIG. 9 is an enlarged view of an important portion of the conventional connector, showing the process of insertion of a metal terminal.

In an embodiment shown in FIG. 7, a tapered insertion guide chamfer portion 7' which is directed outwardly is formed on each of a tapered insertion guide portion 6*a* (formed on a front end of each stabilizer 6" of a metal terminal $B_2$") and a lower end 6*b*" of the stabilizer.

As described above, in the present invention, the connector comprises the connector housing having the rearwardly-opening terminal receiving chambers, and the metal terminals each having projected stabilizers, the tapered insertion guide portion being formed at at least one of the front end of the stabilizer and the rear end of the side wall forming the terminal receiving chamber. Alternatively, the tapered insertion guide chamfer portion which is directed outwardly is formed at the front end of the stabilizer. Therefore, when the stabilizer is abutted against the rear end of the side wall of the terminal receiving chamber during the insertion of the metal terminal, the insertion posture of the metal terminal is automatically corrected by the tapered insertion guide portion, and therefore the insertion can be effected smoothly to facilitate the operation.

What is claimed is:

1. A connector, comprising:

a connector housing having a rearwardly-opening terminal receiving chamber at least partially defined by a pair of substantially parallel side walls; and an elongate terminal having an electrical contact portion (4) at a front end of said terminal, a wire connection portion (5) at a rear end of said terminal, and at least two stabilizers protruding from a portion of said terminal substantially midway between said electrical contact portion and said wire connection portion and in a direction substantially perpendicular to a direction in which the terminal is inserted into the chamber, wherein at least one of a front end of said stabilizers and a rear end of said side walls, said front end of said stabilizers contacting said rear end of said side walls when said terminal is inserted in a tilted manner in said receiving chamber, being inclined along substantially the entire length thereof so as to form a tapered insertion guide portion which facilitates rotation of said terminal about its longitudinal axis when inserted in the tilted manner.

2. A connector as recited in claim 1, wherein at least one of said front end of said stabilizers and said rear end of said side walls are chamfered to facilitate rotation of said terminal about its longitudinal axis when inserted in the titled manner.

3. A connector comprising:

a connector housing;

at least one terminal insertable into said connector housing along an insertion axis; and cam means for rotating said terminal about said insertion axis in association with an insertion motion of said terminal into said connector housing to correctly position said terminal relative to said connector housing without stopping said insertion motion, wherein said cam means includes a projection formed on said terminal between an electrical contact portion and a wire connection portion of said terminal, and an end wall formed on said connector housing and abuttable against said projection during said insertion motion, at least one of mutually abuttable surfaces of said projection and said end wall being inclined with an acute angle relative to said insertion axis to allow said projection to slide on said end wall to cause rotation of said terminal in association with said insertion motion thereof.

4. A connector comprising:

a connector housing;

at least one terminal insertable into said connector housing along an insertion axis; and cam means for rotating said terminal about said insertion axis in association with an insertion motion of said terminal into said connector housing to correctly position said terminal relative to said connector housing without stopping said insertion motion, wherein said cam means includes a projection formed on said terminal between an electrical contact portion and a wire connection portion of said terminal, and an end wall formed on said connector housing and abuttable against said projection during said insertion motion, at least one of mutually abuttable surfaces of said protection and said end wall being formed with a chamfered portion to allow said projection to slide on said end wall to cause rotation of said terminal in association with said insertion motion thereof.

5. A connector as recited in claim 4, wherein said chamfered portion is chamfered in a direction substantially perpendicular to the insertion axis.

6. A connector, comprising:

a connector housing having a rearwardly-opening terminal receiving chamber at least partially defined by a pair of substantially parallel side walls; and an elongate terminal having an electrical contact portion (4) at a front end of said terminal, a wire connection portion (5) at a rear end of said terminal, and at least two stabilizers protruding from a portion of said terminal substantially midway between said electrical contact portion and said wire connection portion and in a direction substantially perpendicular to a direction in which the terminal is inserted into the chamber, wherein at least one of a front end of said stabilizers and a rear end of said side walls, said front end of said stabilizers contacting said rear end of said side walls when said terminal is inserted in a tilted manner in said receiving chamber, being chamfered along substantially the entire length thereof so as to facilitate rotation of said terminal about its longitudinal axis when inserted in the tilted manner.

7. A connector as recited in claim 6, wherein said front end and a lower end of said stabilizers are chamfered along substantially the entire length thereof.

8. A connector as recited in claim 6, wherein at least one of said front end of said stabilizers and said rear end of said side walls are tapered to facilitate rotation of said terminal about its longitudinal axis when inserted in the tilted manner.

9. A connector as recited in claim 6, wherein said at least one of the front end of said stabilizers and the rear end of said side walls is chamfered in a direction substantially perpendicular to the longitudinal axis of said terminal.

* * * * *